US010455871B2

(12) United States Patent
Pearce

(10) Patent No.: US 10,455,871 B2
(45) Date of Patent: Oct. 29, 2019

(54) PERSONAL PROTECTIVE SYSTEM

(71) Applicant: SURGIVISOR LIMITED, Sevenoaks, Kent (GB)

(72) Inventor: Simon Pearce, Sevenoaks (GB)

(73) Assignee: SURGIVISOR LIMITED, Sevenoaks, Kent (GB)

( * ) Notice: Subject to any disclaimer, the term of this patent is extended or adjusted under 35 U.S.C. 154(b) by 1002 days.

(21) Appl. No.: 14/918,457

(22) Filed: Oct. 20, 2015

(65) Prior Publication Data

US 2016/0058080 A1 Mar. 3, 2016

Related U.S. Application Data

(63) Continuation of application No. PCT/GB2014/051263, filed on Apr. 23, 2014.

(30) Foreign Application Priority Data

Apr. 23, 2013 (AU) ..... 2013901424

(51) Int. Cl.
*A41D 13/11* (2006.01)
*A41D 13/05* (2006.01)

(52) U.S. Cl.
CPC ..... *A41D 13/1107* (2013.01); *A41D 13/1161* (2013.01); *A41D 13/1184* (2013.01); *A41D 13/0518* (2013.01)

(58) Field of Classification Search
CPC ..... A41D 13/1184; A41D 13/1218; A41D 13/11; A41D 13/1107; A41D 13/1153; A41D 13/1161; A41D 13/0512; A41D 13/0518; A62B 17/04; A62B 17/00; A62B 18/08; A62B 18/00; A42B 3/20; A42B 3/205
USPC ..... 2/9, 15, 11; 128/201.24, 201.29
See application file for complete search history.

(56) References Cited

U.S. PATENT DOCUMENTS 2,016,775 A * 10/1935 Gingg ..... A61F 9/06 2/8.2
2,296,338 A * 9/1942 Dakin ..... A62B 18/04 128/201.15
2,579,942 A * 12/1951 MacLean ..... A61F 9/068 128/201.25
2,700,158 A * 1/1955 Larsen ..... A61F 9/06 2/453
2,725,559 A * 12/1955 Wagner ..... A61F 9/06 2/8.1

(Continued)

FOREIGN PATENT DOCUMENTS

EP 0 316 291 A1 5/1989

OTHER PUBLICATIONS

International Search Report dated Jul. 30, 2014 in International Application No. PCT/GB2014/051263.

*Primary Examiner* — Amy Vanatta
(74) *Attorney, Agent, or Firm* — Perkins Coie LLP; Alberto Araiza; Viola T. Kung

(57) ABSTRACT

A protective apparatus for coverage of the face, neck and upper torso, comprising: a. a headpiece (10) comprising a headband (12) and a mandible guard (14), wherein the mandible guard is attached to the headband, the headpiece further comprising at least one attachment point; b. a visor (24); and c. a skirt (26); wherein the visor and the skirt are adapted so as to attach to the headpiece via the at least one attachment point.

20 Claims, 15 Drawing Sheets

(56) References Cited

U.S. PATENT DOCUMENTS 2,881,443 A * 4/1959 Barker, Jr. ..... A61F 9/025 2/9
3,339,207 A * 9/1967 Perry ..... A61F 9/061 2/8.3
3,878,563 A * 4/1975 Pulju ..... A41D 13/1161 2/9
3,955,570 A * 5/1976 Hutter, III ..... A41D 13/1153 128/201.23
4,286,170 A 8/1981 Moti et al.
4,619,254 A * 10/1986 Moretti ..... A62B 17/04 128/201.23
4,901,716 A 2/1990 Stackhouse et al.
4,944,294 A * 7/1990 Borek, Jr. ..... A41D 13/11 128/201.15
4,945,574 A * 8/1990 Dagher ..... A61F 9/02 128/201.12
4,965,887 A 10/1990 Paoluccio et al.
5,054,480 A 10/1991 Bare et al.
5,406,944 A * 4/1995 Gazzara ..... A41D 13/1184 128/201.12
5,500,954 A 3/1996 Smith et al.
5,732,410 A * 3/1998 Machson ..... A61F 9/02 128/857
7,093,302 B1 * 8/2006 Burns ..... A61F 9/06 2/8.1
9,522,084 B2 * 12/2016 Wilson ..... A61F 9/04
9,949,517 B2 * 4/2018 Howard ..... A41D 13/1184
2007/0028372 A1 * 2/2007 VanDerWoude ... A41D 13/1153 2/457
2009/0151054 A1 6/2009 VanDerWoude et al.
2012/0260389 A1 * 10/2012 Gosine ..... A41D 13/1184 2/9
2013/0014316 A1 * 1/2013 Castro ..... A41D 13/1184 2/424
2013/0091624 A1 * 4/2013 Czajka ..... A41D 13/1209 2/456
2014/0189942 A1 * 7/2014 Coombs ..... A42B 1/247 2/424
2015/0090254 A1 * 4/2015 Pavalarajan ..... A62B 18/045 128/201.23
2018/0084848 A1 * 3/2018 Pavalarajan ..... A41D 13/1153

* cited by examiner

PERSONAL PROTECTIVE SYSTEM

This application is a continuation of PCT application No. PCT/GB2014/051263, filed Apr. 23, 2014; which claims the priority of Application No. AU 2013901424, filed Apr. 23, 2013. The above applications are incorporated herein by reference in their entireties.

FIELD

The present invention relates to personal protection systems, in particular masks for the protection of the face, neck and upper torso area of a user. The present invention particularly relates to masks for use in medicine, for example, by surgeons in operating theatres.

BACKGROUND

Personal protection systems are known in the art. These are typically worn by medical practitioners operating on a patient in front of and below them. Their main function is to protect the patient from contamination from the practitioner's respiratory pathogens and shed skin cells and also to protect the practitioner from airborne fluid and debris. They require an unobstructed view whilst offering free range of movement and comfort.

Presently there are two broad categories of such systems. The first is a simple non-sterile face mask which is closely applied to the mouth and nose and may include an attached visor or a separate eye-protection garment. The second is a self-contained, sterile exhaust suit consisting of a helmet mounted fan and separate power supply over which is draped a hood with a visor set into it. Both systems are used in conjunction with a sterile surgical gown which covers as far as the base of the neck and an non-sterile surgical hat which covers the hair and forehead.

Both systems have their limitations. The first system leaves large parts of the head and neck uncovered exposing the patient to potential contamination from the practitioner's skin and exposing the practitioner to airborne fluid and debris. In addition, the close application of the mask and visor to the skin is uncomfortable.

The second system covers all the head and neck but at the expense of creating an enclosed space allowing the build-up of expired gases, heat and moisture necessitating a head-mounted fan to circulate air. This makes the helmet bulky, heavy and noisy. It also requires a power source in the form of a battery mounted on the waistband connected to the helmet by a long wire. The top and sides of the visor in the second system are covered by an opaque fabric, significantly limiting peripheral vision particularly above the head where hanging obstacles such as operating room lights and screens are the frequent source of collisions thereby desterilising the hoods themselves and light handles. Communication is severely hampered due to the noise of the fan particularly when the second party is wearing the same system. Any loss of power due to flat battery or faulty connection causes rapid build-up of heat, fogging of the visor and $CO_2$ build up which becomes intolerable in under 30 seconds necessitating the practitioner to scrub out of the operation while the problem is remedied which can be hazardous to the patient.

Recent research questions the effectiveness of these exhaust suits at preventing infection in joint replacement surgery concluding that they may even increase infection rates. There is also research showing that the $CO_2$ levels sampled within the hood after a typical operation's length is significantly higher than atmospheric levels.

The present invention bridges the gap between these two systems. It provides an effective barrier between the practitioner and the patient with the barrier materials held away from the practitioner's face. It is comfortable as it is lightweight, slim and quiet. It does not require power to allow effective circulation of heat, moisture and expired gases and allows unobstructed communication and peripheral vision.

SUMMARY OF THE INVENTION

In its primary aspect the invention provides a protective apparatus for coverage of the face, neck and upper torso, comprising:

a. a headpiece comprising a headband and a mandible guard, wherein the mandible guard is attached to the headband, the headpiece further comprising at least one attachment point;
b. a visor; and
c. a skirt;

wherein the visor and the skirt are adapted so as to attach to the headpiece via the at least one attachment point.

Typically, the mandible guard is attached to the headband by one or more support members, suitably these may be in the form of struts. Suitably the mandible guard does not contact the face when in use. The at least one attachment point is positioned on the mandible guard and/or the one or more support members. The mandible guard acts as a support that is spaced apart from and follows the line of the jaw of the user.

In an embodiment, the means of attachment of the attachment point is selected from the group of hook and loop tape such as Velcro®, magnets, press-stud, adhesive, or a combination thereof. Suitably the means of attachment of the attachment point is hook and loop tape.

Suitably, the headpiece further comprises at least one fixing point, wherein the at least one fixing point engages with the visor prior to, during, or after the visor is attached to the headpiece. In an embodiment, the at least one fixing point engages the visor to locate it in the correct juxtaposition relative to the headpiece prior to the attachment of the visor to the headpiece. Typically, the at least one fixing point positioned at the front apex of the mandible guard. In an embodiment of the invention, the fixing point has a means of fixing selected from the group consisting of: a hook, a lug, a press-stud, a pin, hook and loop fastening tape (Velcro®), magnets, adhesive, or a combination thereof. Suitably the at least one fixing point is a hook.

In an embodiment, the visor comprises at least a transparent portion. Suitably the transparent portion of the visor occupies at least 60% of the area within the field of view of the user, wherein the field of view of the user is defined as the normal visual field of the user when operating and may comprise areas directly peripheral to the main line of vision. Suitably the transparent portion occupies 100% of the area within the field of view of the user.

In an embodiment the visor comprises a flexible material and typically extends upwardly from the mandible guard to at least the height of the headband substantially covering the face of the user. Suitably, on a plane P that bisects the headband down a central line from front to back, the visor intersects the straight line between the front apex of the mandible guard and front most point of the headband with an internal angle of more than 0°. Suitably the internal angle is in the range from of from 10 to 60°. Suitably there is a gap between the front most point of the headband and the visor.

Suitably the visor has as least one cooperative attachment points that align and attach to the at least one attachment means on the headpiece.

In an embodiment, the headband is circumferentially adjustable. The means of adjustment of the circumference of the headband is selected from the group consisting of: a mechanical adjuster, plastic snap fitting, buckle, Velcro®, or elasticated means. Suitably the means of adjustment is by a mechanical adjuster.

In a further embodiment, in use the skirt extends downwardly from the headpiece around a substantial part of the circumference of the user's head. Suitably the skirt portion extends downwardly from the headpiece around the entire circumference of the user's head such that the skirt covers all, or a substantial part of the user's neck and upper torso when in use. Typically, the skirt comprises two arms and an extended torso portion, wherein the skirt further comprises fixing means towards the end of at least one arm. Suitably the fixing means are fixed at the rear of the head. The fixing means may suitably fix to each other or to the headband. Suitably the skirt further comprises an extended torso portion to cover the top front part of the chest in use.

In an embodiment, the skirt is made of material selected from the group consisting of fabric, and a flexible polymeric material. Suitably the material is non-woven fibre such as cellulose or paper, cotton, gauze, silk, polyester, moisture-wicking fabric such as Coolmax®, or elastic fiber material such as Lycra®. The material may suitably coated to provide enhanced properties. Typically, the properties enhanced are antibacterial/antimicrobial properties, flame-retardant properties, hydrophobic/hydrophilic properties, or waterproof/breathable properties.

Suitably the visor and skirt are formed as a two-part unit.

In a second aspect the invention provides a protective apparatus for coverage of the face, neck and upper torso, comprising:

a. a headpiece comprising a headband, a mandible guard and one or more support members, wherein the mandible guard is attached to the headband via the one or more support members; the headpiece further comprising at least one attachment point on the mandible guard and/or the support members;

b. a protective visor unit comprising
   a visor portion; and
   a skirt portion;

wherein the visor portion is attached to the skirt portion to form a single unitary piece, and wherein the protective visor unit is able to attach to the headpiece via the at least one attachment point.

A third aspect the invention provides a protective visor unit, comprising:

a. a visor portion; and b. a skirt portion, wherein the visor portion is attached to the skirt portion to form a single unitary piece.

The protective visor unit may be sterile or non-sterile.

In an embodiment the visor portion comprises at least a transparent portion. Suitably the transparent portion of the visor portion occupies at least 60% of the area within the field of view of a user. Suitably the transparent portion occupies 100% of the area within the field of view of the user.

In an embodiment the visor portion comprises a flexible material.

In a further embodiment, in use the skirt portion extends downwardly from the headpiece around a substantial part of the circumference of the user's head. Suitably the skirt portion extends downwardly from the headpiece around the entire circumference of the user's head such that the skirt covers all, or a substantial part of the user's neck and upper torso when in use. Typically the skirt portion comprises two arms and an extended torso portion, wherein the skirt portion further comprises fixing means towards the end of at least one arm. The fixing means may suitably fix to each other or to the headband. Suitably the skirt portion further comprises an extended torso portion to cover the top front part of the chest in use.

In an embodiment the skirt portion is made of material selected from the group consisting of fabric, and a flexible polymeric material. Suitably the material is non-woven fibre such as cellulose or paper, cotton, gauze, silk, polyester, moisture-wicking fabric such as Coolmax®, or elastic fiber material such as Lycra®. The material may suitably be coated to provide enhanced properties. Typically the properties enhanced are antibacterial/antimicrobial properties, flame-retardant properties, hydrophobic/hydrophilic properties, or waterproof/breathable properties.

In an embodiment the visor portion is attached to the skirt portion by plastic welding, stitching, gluing, a zip, or contact adhesive. Suitably the visor portion is attached to the skirt portion by plastic welding.

Suitably the sterile visor unit is provided in a sealed pack.

In a fourth aspect, the invention provides a headpiece, comprising a headband and a mandible guard, wherein the mandible guard is attached to the headband, the headpiece further comprising at least one attachment point. The headpiece may be sterile or non-sterile.

Typically, the mandible guard is attached to the headband by one or more support members, suitably these may be in the form of struts. Suitably the mandible guard does not contact the face when in use. Suitably, the at least one attachment point is positioned on the mandible guard and/or the one or more support members.

In an embodiment, the headband is circumferentially adjustable. Suitably the means of adjustment of the circumference of the headband is selected from the group consisting of: a mechanical adjuster, plastic snap fitting, buckle, Velcro®, or elasticated means. Suitably the means of adjustment is by a mechanical adjuster.

DRAWINGS

The invention is illustrated by the following drawings in which.

DETAILED DESCRIPTION

All references cited herein are incorporated by reference in their entirety. Unless otherwise defined, all technical and scientific terms used herein have the same meaning as commonly understood by one of ordinary skill in the art to which this invention belongs.

The invention provides for personal protective equipment for the face, neck and upper torso, typically in the form of a mask comprising a face shield, and a skirt that covers the user's neck and at least part of the user's upper torso.

In its broadest configuration the mask of the invention comprises a visor, a headpiece and a skirt.

FIGS. 1 to 4 show various views of an embodiment of the invention.

Figure 1:
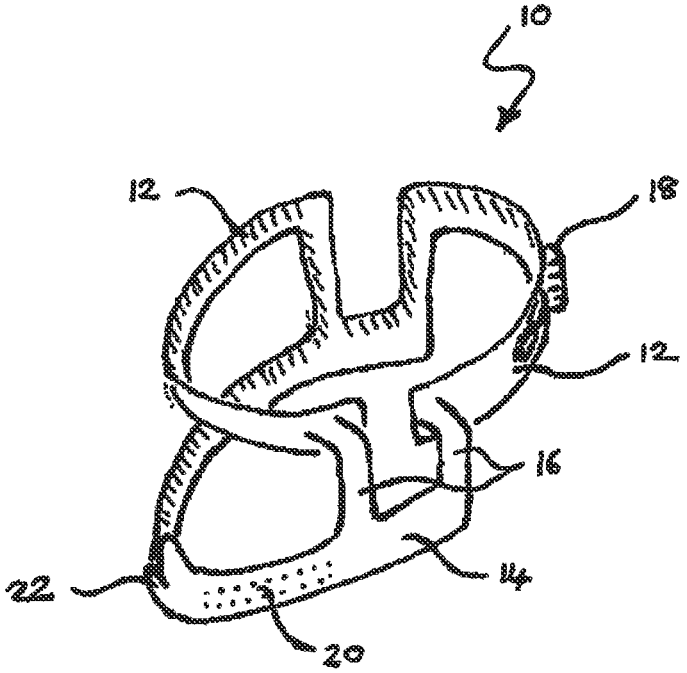
FIG. 1 shows a front perspective view of the headpiece of an embodiment the present invention.

As shown in FIG. 1, the headpiece 10 of an embodiment of the invention comprises a headband 12 and a mandible guard 14 attached to the headband via one or more struts 16. The headband 12 is shaped to fit the head, and in use generally encircles the head of the user at a line above the brow at the front to the occiput at the back of the head. The headband acts to secure the headpiece to the head of the user and prevent undesirable movement of the protective mask.

The headband 12 may be contiguous (not shown), or it may be interrupted or partial. The headband may have a fixed circumference, or it may be adjustable. Adjustment of the circumference of the headband may be by any suitable means, for example, via a mechanical adjuster 18, plastic snap fitting, buckle, Velcro®, or elasticated means. In one embodiment, the headband 12 comprises a strap that is joined to opposing sides of the headband 12 passing over, while not entirely covering, the top of the head to prevent the mask dropping (not shown).

The mandible guard 14 extends around the lower portion of the user's face, generally following the contour of the user's mandible. Suitably the mandible guard 14 is shaped such that in use it does not contact the face of the user. The mandible guard 14 acts to support and position the visor and skirt of the mask. The shape and positioning of the mandible guard away from the face of the user holds the visor and skirt of the mask away from the face of the user providing enhanced freedom of movement and an improved field of vision.

The length of the mandible guard 14 may be fixed or it may be adjustable (not shown). Adjustment of the length of the mandible guard may be by any suitable means, for example, a mechanical adjuster, plastic snap fitting, a buckle, or Velcro®. Adjusting the length of the mandible guard provides a means of varying the distance of the visor and skirt, when fixed to the mandible guard, from the face.

The mandible guard 14 is supported and held in position by one or more struts 16 that depend from the headband 12. The struts 16 project generally down at least one side of the user's face at the edge of or behind the user's field of view when in use so as not to impede the user's peripheral vision.

The struts 16 are generally elongate members attached to the headband 12 at one end and the mandible guard 14 at the other. The struts may be any shape in cross-section, suitably the struts 16 are circular, square or rectangular in cross-section. In one embodiment, the struts 16 may be formed as one continuous piece with the headband 12 and/or the mandible guard 14. Alternatively, the struts may be fastened to the headband and/or mandible guard, where the means of fastening may be selected, for example, from the group of pins, rivets, screws, staples, welding and adhesive. The means of fastening the struts 16 to the headband and/or mandible guard may be fixed or removable.

The headband 12, mandible guard 14, struts 16 may be formed of the same material or each may be of a different material. Suitable materials for each of the headband 12, mandible guard 14, struts 16 may be metal, metal reinforced plastics, or rigid plastics. Metals, or metals to be used to reinforce plastic, may be selected from, for example, the group of steel, stainless steel, aluminium and titanium, or alloys thereof. Plastics, used alone or reinforced by metal may be selected from, for example, the group of poly (methylmethacrylate) (PMMA), polyethylene terephthalate (PET), polycarbonate and polyethylene.

In an embodiment of the invention, the mandible guard 14 and/or the vertical struts 16 have one or more attachment points 20 for the visor. The type, number and positioning of the attachment points 20 is such that once the visor is mounted on the attachment points it is held securely on the headpiece 10. The attachment points 20 may be limited to distinct areas on the mandible guard 14 and/or the vertical struts 16, or may be continuous around the entire perimeter of the mandible guard 14 and/or the vertical struts 16. Depending on the arrangement of the headband 12, mandible guard 14 and struts 16, it is contemplated that attachments points 20 for the visor may also be present on the headband. The attachment of the visor to the headpiece 10 at the attachment points 20 may be by any suitable means. Fixed attachment means may be selected, for example, from the group of pins, rivets, screws, staples, welding and adhesive, or a combination thereof. Suitably the attachment is temporary by means selected, for example, from the group of Velcro®, press-stud, adhesive, or a combination thereof. It will be appreciated that the attachment of the visor to the mask may be fixed or temporary.

Optionally, and either in addition to or instead of the attachment points 20, the mandible guard 14 or struts 16 have one or more fixing points 22 for the visor that act to attach the visor to the headpiece or alternatively to act to locate the visor on the mandible guard prior to attachment on the attachment points 20. The one or more fixing points may take the form of a hook, lug, press-stud, pin, Velcro®, magnets, adhesive, or a combination thereof. The one or more fixing points may be positioned anywhere on the mandible guard 14 or the struts 16. Suitably there is single fixing point in the form of a moulded hook at the exterior apex of the mandible guard which locates in a corresponding opening formed in the visor.

Figure 2:
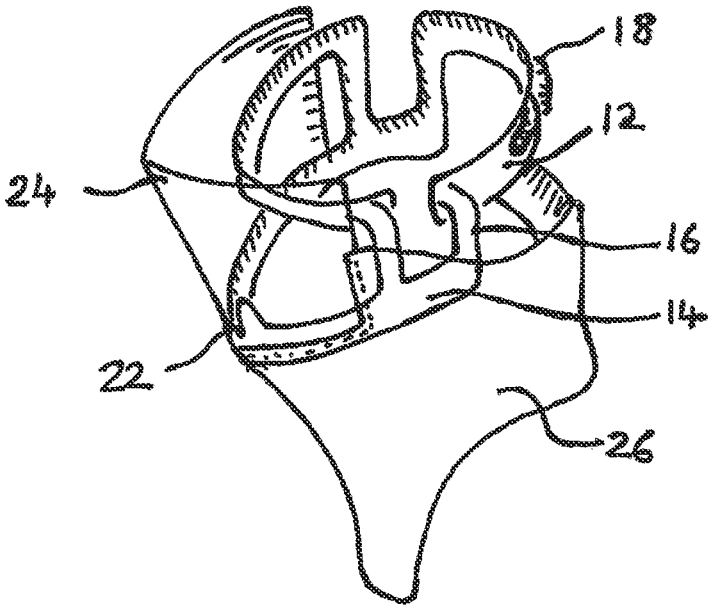
FIG. 2 shows a front perspective view of an embodiment of the present invention including headpiece, attached visor, and skirt.

FIG. 2 shows a mask according to an embodiment of the invention complete with the headpiece 10, the visor 24 and skirt 26.

The visor 24 acts to protect the user's face, and in particular the eyes, from airborne fluids and debris. In an embodiment of the invention it provides a physical barrier between a clinician and a patient. The visor 24 is formed from a sheet of material that has at least a transparent portion. The transparent portion of the visor 24 is at least 60%, 70%, 80%, 90%, preferably 100% of the area within the field of view of the user when the mask is worn. The visor is positioned substantially in front of the face of the user when in use.

Typically, the visor 24 extends upwardly from the mandible guard. When in use, the visor 24 extends sufficiently upward to be in front of at least a part of the face of the user, suitably the visor 24 extends to be at least above the level of the eyes of the user, in an embodiment of the invention, the visor extends upwardly beyond the line of the headband 12 thereby covering the entire face of the user. The visor 24 may be oriented such that the visor 24 extends upwardly away from the user's face, that the visor 24 extends upwardly towards from the user's face, or that the visor 24 extends upwardly such that it remains substantially equidistant from the user's face.

The visor 24 may be flexible or non-flexible. In embodiments of the invention where the visor 24 is flexible, the visor 24 will take its desired shape when attached to the headpiece 10. In embodiments of the invention where the visor is non-flexible, the visor can be pre-curved to fit the contours of the headpiece 10 to which it attaches. In embodiments of the invention with attachment points 20 on the mandible guard 14 and struts 16, and optionally the headband 12, that require cooperative attachment points to function, for example the hook and loop arrangement in Velcro®, the visor 24 will suitably have cooperative attachment points (not shown) that align with attachment points 20 on the mandible guard 14 and struts 16, and optionally the headband 12 when the visor is mounted.

The visor 24 may be formed of any transparent material selected from the group of glass, plastics, resins, cellulose materials and inorganic crystal. Suitably, the visor is formed of flexible plastic, for example, plastic selected from the group of poly(methylmethacrylate) (PMMA), polyethylene terephthalate (PET), polycarbonate and polyethylene.

The visor may be sterile or non-sterile. In one embodiment, the visor 24 has been sterilised to provide a visor that is substantially free from living matter, suitable for use in the sterile environment of, for example, an operating theatre.

Alongside the protection of the face provided by the visor 24, protection of the neck and upper torso of the user is of importance in many environments, in particular, when the mask is used in a surgery, or other medical procedures. Protection may be offered by a suitable physical barrier, such as a drape, or bib or a skirt, depending from the headpiece 10 which provides a substantially continuous barrier between the user and the environment.

In an embodiment of the invention, the skirt 26 acts to protect the neck and upper torso from debris and airborne fluids. The skirt 26 extends downwardly from the headpiece around a substantial part of the circumference of the user's head. Suitably the skirt 26 extends downwardly from the headpiece around the entire circumference of the user's head such that the skirt 26 covers all, or a substantial part of the user's neck and upper torso when in use.

It is contemplated that the skirt 26 may attach directly to the headpiece 10, or any part of it. As better shown in FIGS. 11 to 14, an alternative embodiment of the invention comprises the skirt 26 formed as a two-portion unit with the visor 24. In this embodiment, the protective visor unit 28 attaches via the visor portion of the unit 28 to the mandible guard 14 and struts 16, and optionally the headband 12, via the attachment points 20, and optionally the fixing points 22.

For reasons of comfort, the skirt 26 may be flexible and suitably shaped to fit anatomically the contours of the user's body. The skirt 26 may be tucked into, or suitably attached to, a shirt, or an operating theatre gown or scrubs. Alternatively, the hem of the skirt 26 may be suitably weighted, for example with beading, to improve the hanging of the skirt 26. For certain uses, a non-flexible skirt may be preferred.

The skirt 26 may be formed of any suitable material. Examples of materials that may be suitably used for the skirt 26 are fabric, or a flexible polymeric material selected from the group of non-woven fibre such as cellulose or paper, cotton, gauze, silk, polyester, moisture-wicking fabric such as Coolmax®, or elastic fibre material such as Lycra®. The fabrics for use in the skirt 26 may be coated to provide enhanced properties, for example, antibacterial/antimicrobial properties, flame-retardant properties, hydrophobic/hydrophilic properties, and waterproof/breathable properties.

The skirt may be sterile or non-sterile. In one embodiment, the skirt 26 can been sterilised, for example by gamma radiation, to provide a skirt that is substantially free from living matter, suitable for use in the sterile environment of, for example, an operating theatre.

Figure 3:
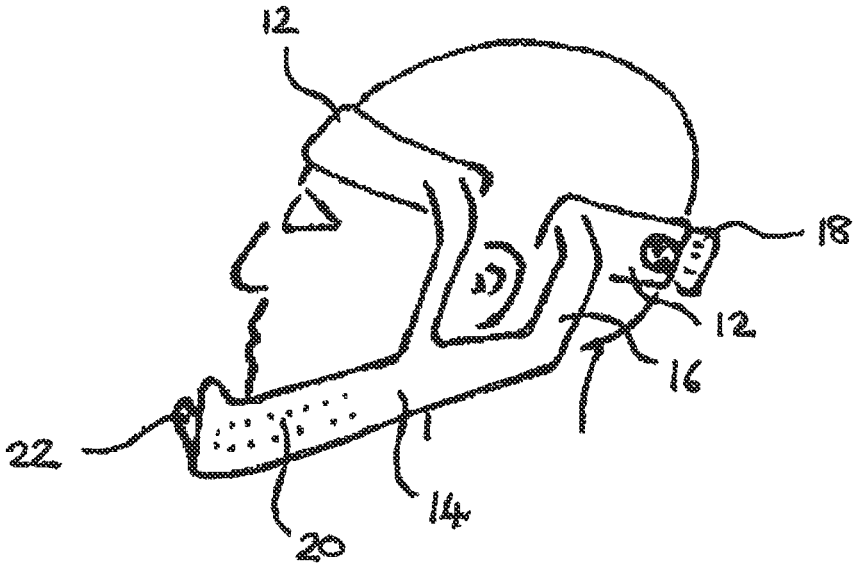
FIG. 3 shows a side view of the headpiece of an embodiment the present invention mounted on a head.

FIG. 3 shows a side view of the headpiece of an embodiment the present invention mounted on a head of a user. The particular arrangement of the headband 12, the mandible guard 14, and struts 16 with respect to the user's face in this embodiment of the invention is shown.

Figure 4:
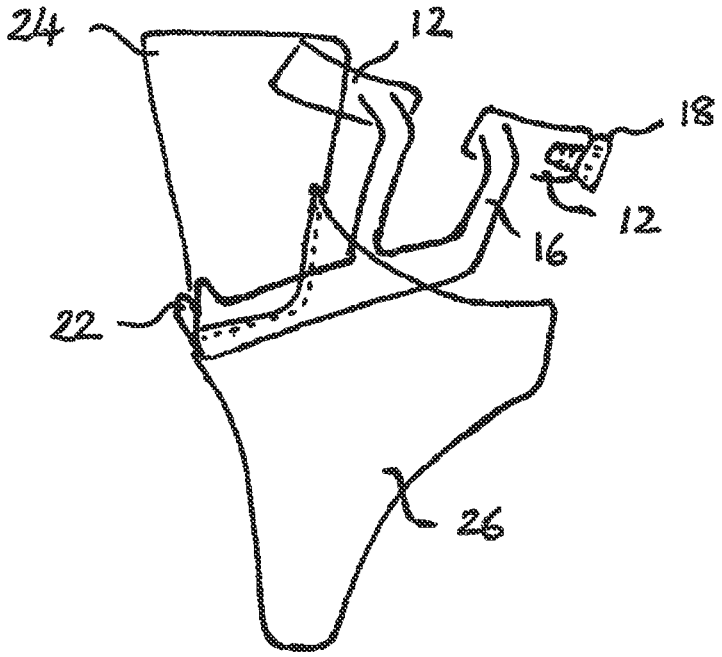
FIG. 4 shows a side view of an embodiment of the present invention including headpiece, attached visor, and skirt.

FIG. 4 shows a side view of an embodiment of the present invention including headpiece 10, attached visor 24, and skirt 26.

Figure 5:
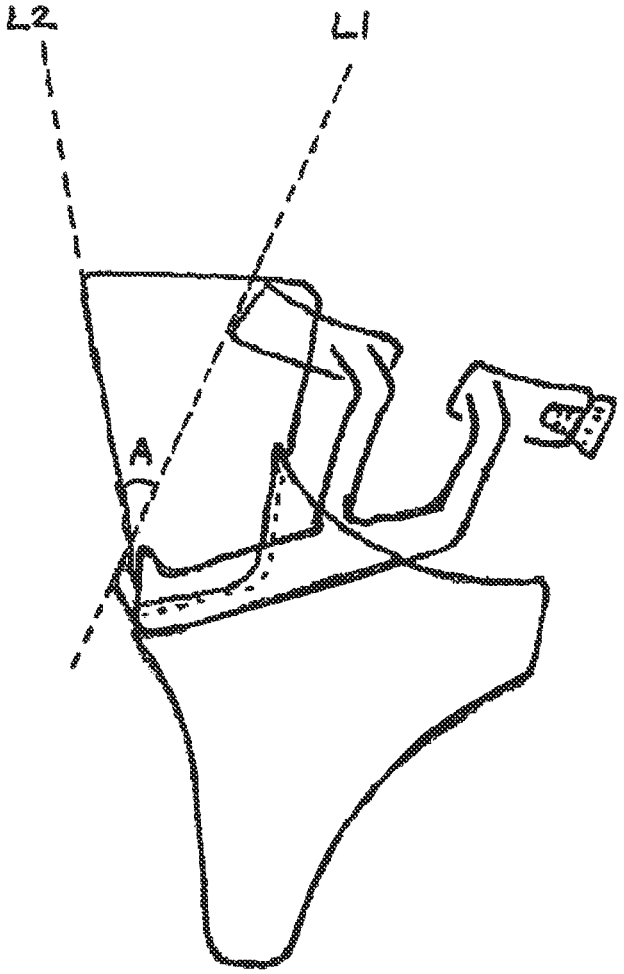
FIG. 5 shows a schematic view of an embodiment of the present invention showing the angle of the visor in relationship to the headpiece.
Figure 6:
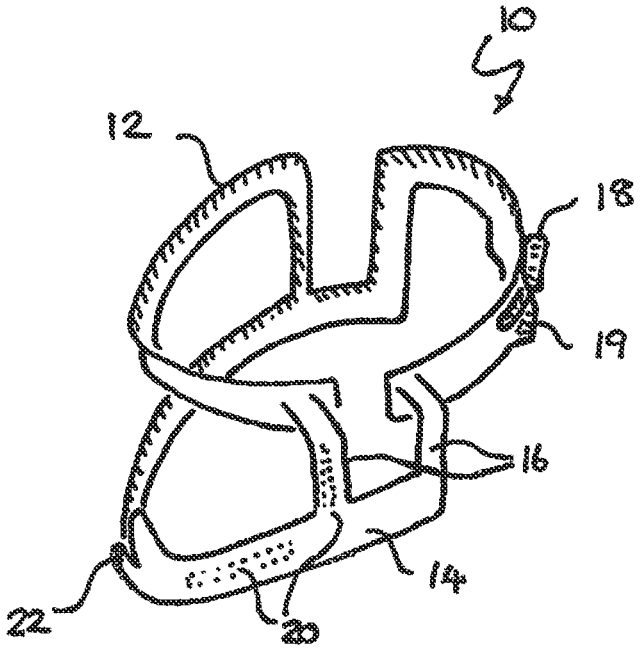
FIG. 6 shows a front perspective view of the headpiece of another embodiment the present invention.
Figure 7:
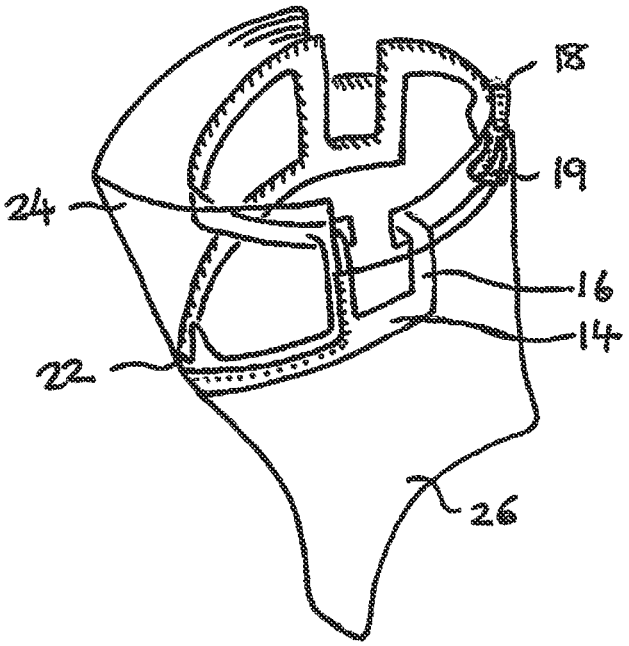
FIG. 7 shows a front perspective view of another embodiment of the present invention including headpiece, attached visor, and skirt.

FIG. 5 shows a side view of the embodiment of the invention of FIGS. 1 to 4 and shows the angle A between lines L1 and L2 that defines the relative orientation of the visor 24 with respect to the headpiece 10.

In FIG. 5, a plane P, defined by the plane of the paper, bisects an embodiment of the mask of the invention down a central line from front to back. A straight line L1 is then defined between the front apex of the mandible guard 14 and the front most point of the headband 12 on plane P. The angle A may then be defined by the internal angle made between line L1 and the line L2 of the visor 24 on plane P at the point of intersection.

Angle A may be any angle. In an embodiment of the present invention, angle A is less than 60°, suitably angle A is less than 50°, 40°, 30°, 20° or 10°. Typically angle A is more than 0°. Suitably angle A may be at least 10°, 20°, 30°, 40°, 50° or 60°. Angle A may be in the range of from 10 to 60°, suitably angle A may be in the range from 20 to 50°, or 30 to 40°.

In embodiments where the angle A is greater than 0°, an opening 30 exists at the top of the mask above the user's face thereby providing *facile* exchange of the user's breath gases with the external environment, while still maintaining an effective physical barrier between the user and the environment. This entirely overcomes, or at least mitigates, the problem of condensation, heat and carbon dioxide build-up inside the mask without the need for active extraction techniques that are essential, for example, in sealed masks. Without the need of extraction fans inside the hood, no external power supply or battery is required to operate the mask. Furthermore, without the noise associated with the extraction fans working in the confines of a sealed hood, communication between the user and those around them is significantly improved. This would be of particular importance in the operating theatre environment where effective communication between those present is essential for the safety and well-being of the patient.

In addition, a mask with a visor 24 at angle A of greater than 20 to 30° provides a generally downward facing orientation of the visor. Such an orientation of the visor would provide an advantageous field of view when working below eye-level, i.e. when the user is looking down. When the visor is placed at an angle away from the face, it also avoids distracting reflections from the user's face, or lights mounted on the side of the mask, on the rear of the visor.

Figure 8:
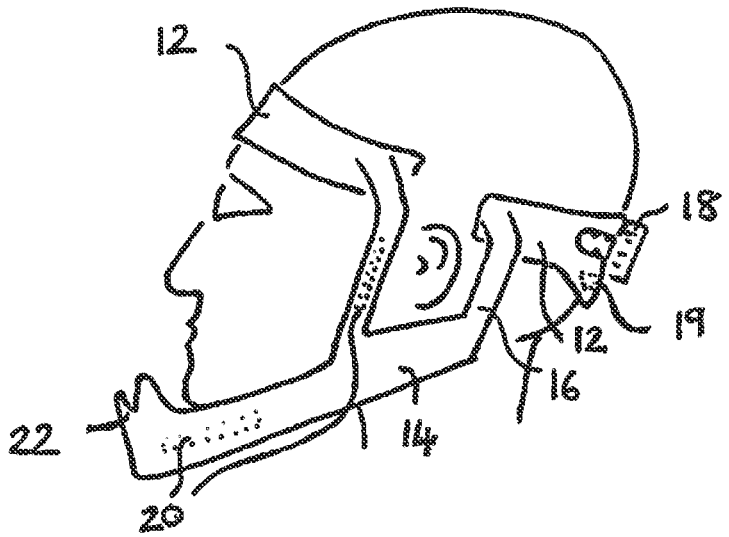
FIG. 8 shows a side view of the headpiece of another embodiment the present invention mounted on a head.
Figure 9:
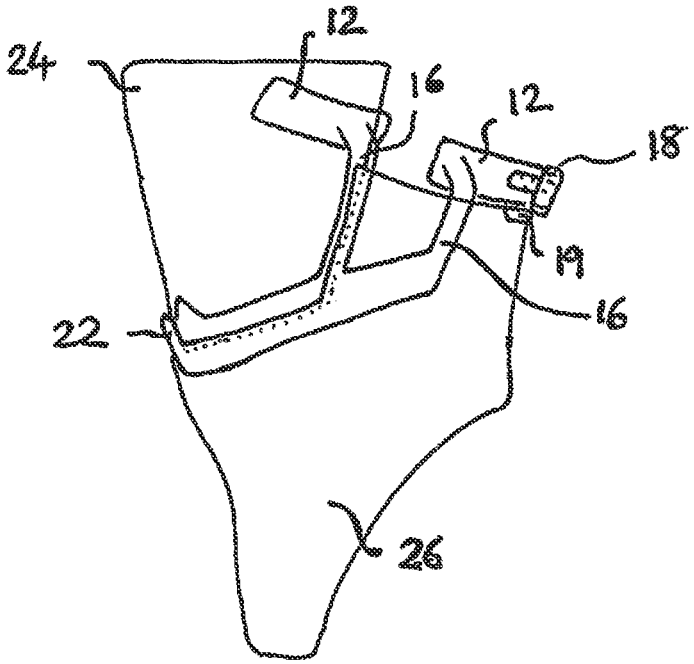
FIG. 9 shows a side view of another embodiment of the present invention including headpiece, attached visor, and skirt.

FIGS. 6 to 9 show corresponding views to those shown in FIGS. 1 to 4 of a further embodiment of the invention. As best seen in FIG. 8, in this embodiment the headband is elongated downwardly at the rear of the head to provide an area 19, that may be used as a rear fixing point for the skirt.

Figure 10:
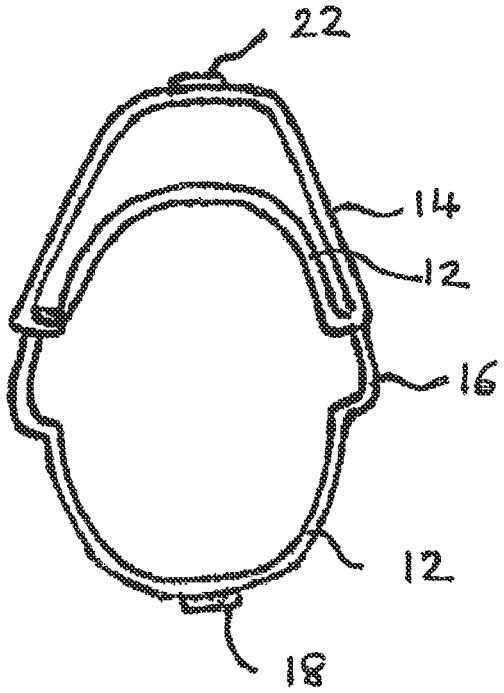
FIG. 10 shows a plan view of the headpiece of an embodiment the present invention.

FIG. 10 shows a plan view of the headpiece of an embodiment the present invention.

Figure 11:
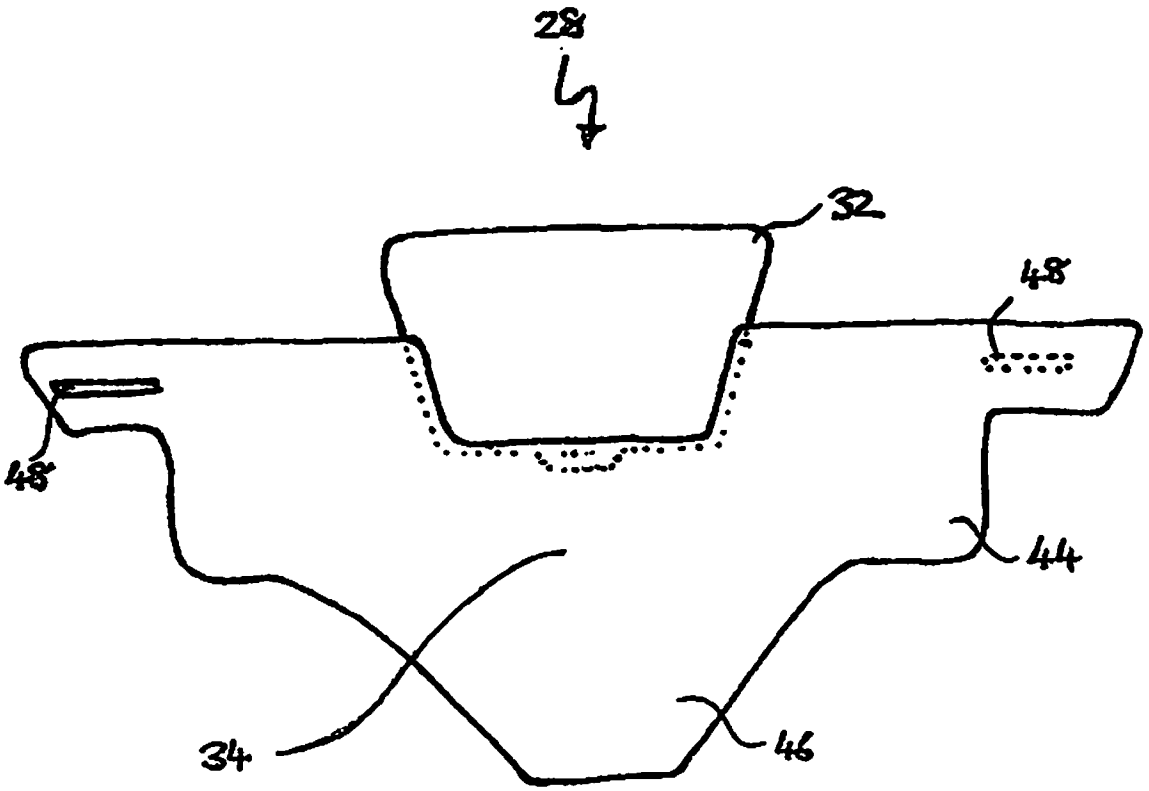
FIG. 11 shows a front view (outside) of the visor and integral skirt according to an embodiment of the present invention.
Figure 12:
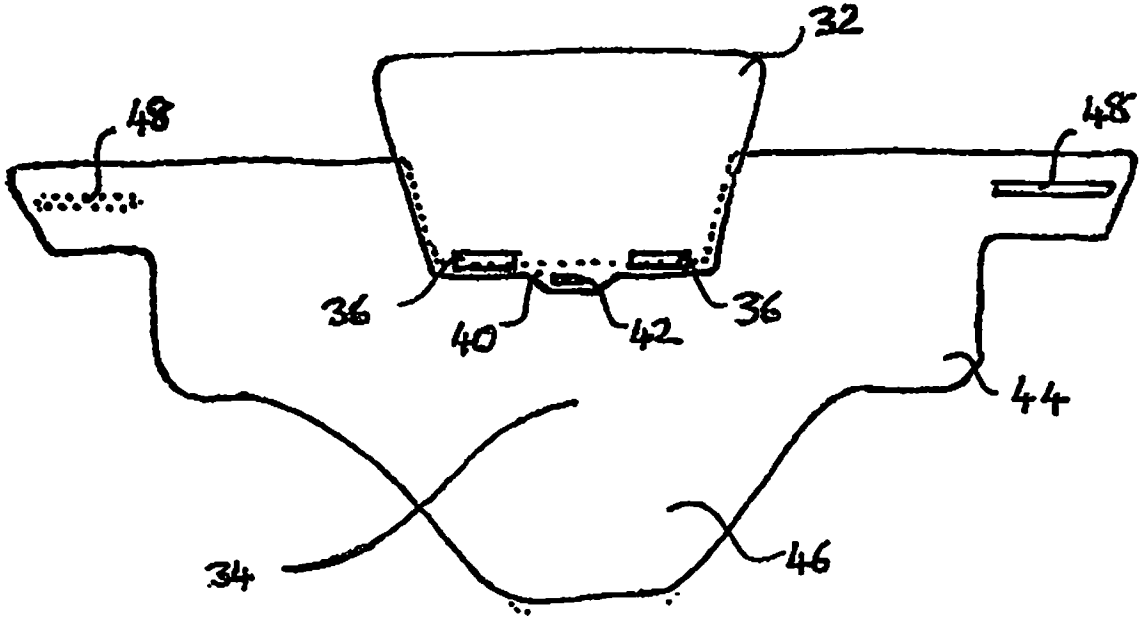
FIG. 12 shows a back view (inside) of the visor and integral skirt according to an embodiment of the present invention.

FIGS. 11 and 12 show the protective visor unit 28 according to an embodiment of the present invention. In the embodiment of the invention shown, the protective visor unit 28 comprises a visor portion 32, and a skirt portion 34. The visor portion 32 is attached to the skirt portion 34 by any suitable means, for example, plastic welding, stitching, gluing, a zip or other contact adhesive. The attachment of the visor portion 32 to the skirt portion 34 may be continual along the entire length of where the two portions meet, or it may be partial or interrupted. Suitably the attachment is continual so that there is a substantially complete seal between the visor portion 32 and the skirt portion 34. The seal may be on either side of the protective visor unit 28. Suitably the seal is on the inside of the visor unit to provide a more aesthetically pleasing final appearance.

As best seen in FIG. 12, in an embodiment of the invention that has attachment points 20 on the mandible guard 14 and struts 16, and optionally the headband 12, that require cooperative attachment points to function, for example the hook and loop arrangement in Velcro®, the visor 24 will suitably have cooperative attachment points 36 on the inside surface of the visor portion 32. These cooperative attachment points 36 align with attachment points 20 on the mandible guard 14 and struts 16, and optionally the headband 12 when the visor is mounted to provide a secure fit.

In embodiments of the invention it may be desired to make use of one or more fixing points 22 on the mandible guard 14 or struts 16 that act to secure the protective visor unit 28 instead of the attachment points 20 or act to locate the visor 24 on the mandible guard 14 prior to attachment on the attachment points 20. In such cases, suitable receiving points may be positioned on the visor portion 32 of the protective visor unit 28 into which the fixing points can locate. The receiving points may be any suitable means for engaging with the at least one fixing point 22. Suitably the receiving point may be selected from the group of hook and loop tape such as Velcro®, magnets, press-stud, adhesive, or a combination thereof, In the embodiment shown, the visor has an extension 40 that is positioned centrally on the unit 28. The extension 40 has formed in it an opening 42 that may suitably accept a corresponding fixing point 22 on the mandible guard 14. The positioning of the extension 40 below the seal between the visor portion 32 and the skirt portion 34 ensures that when the fixing point 22 on the mandible guard is inserted into the opening 42, it remains covered on the external face of the protective visor unit 28 by the skirt portion 34. In an embodiment of the invention where the protective visor unit 28 is sterile, and the headpiece 10, including the mandible guard 14 is not, this is particularly advantageous as it maintains the sterile surface of the mask exposed to the patient.

The skirt portion of the unit 28 generally consists of two arms 44 that extend laterally from each side of the visor portion 32 and a torso portion 46 that extends longitudinally down (as shown) from the visor portion 32.

The two arms 44 of the skirt portion 34 may be equal in length or they may be unequal. To provide a skirt portion 34 on mask of the present invention that extends around the entire circumference of the user's head such that the skirt portion 34 covers all, or a substantial part of the user's neck and upper torso when in use, the total length of the arms 44 is approximately that of the circumference of the average adult human head. The total length of the arms may be reduced if only partial enclosure of the neck and upper torso of the wearer is required.

At the end, or generally towards the end of one or both arms, there is a fixing means 48. The fixing means 48 acts to hold the ends of the arms together when the protective visor unit 28 is donned. The fixing means 48 on one arm can be fastened to the other arm at or close to the back of the head. In the embodiment shown, fixing means 48 on both arms may be fastened to each other at or close to the back of the head. In a further embodiment, fixing means 48 on both arms may be fastened to the elongation of the headband 12 at the rear of the head at area 19 as shown best in FIG. 8. The means of fastening may be selected, for example, from the group of pins, staples, Velcro® and adhesive. Alternatively the arms 44 may be tied together in a knot or a bow.

In an embodiment of the invention, the fixing means 48 is present on an extended portion 50 on the end of one or both arms.

The torso portion 46 of the skirt portion 34 extends the length of the skirt portion 46 at the front of the user when in use. This is advantageous in that is provides additional barrier protection to the area at the front of the body which is most likely to be exposed to debris and contaminants, and it also acts to prevent the skirt portion from untucking once it has been positioned inside surgical gowns.

The protective visor unit may be sterile or non-sterile.

Figure 13:
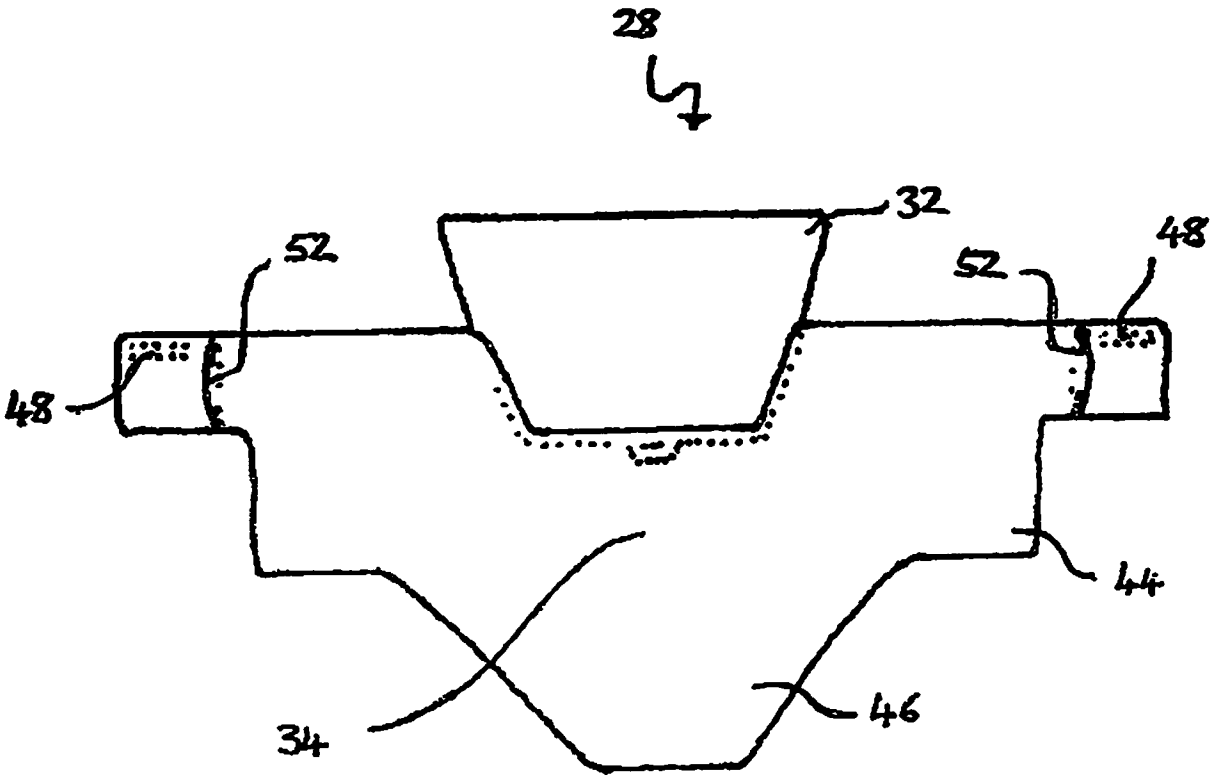
FIG. 13 shows a front view (outside) of the visor and integral skirt according to another embodiment of the present invention.
Figure 14:
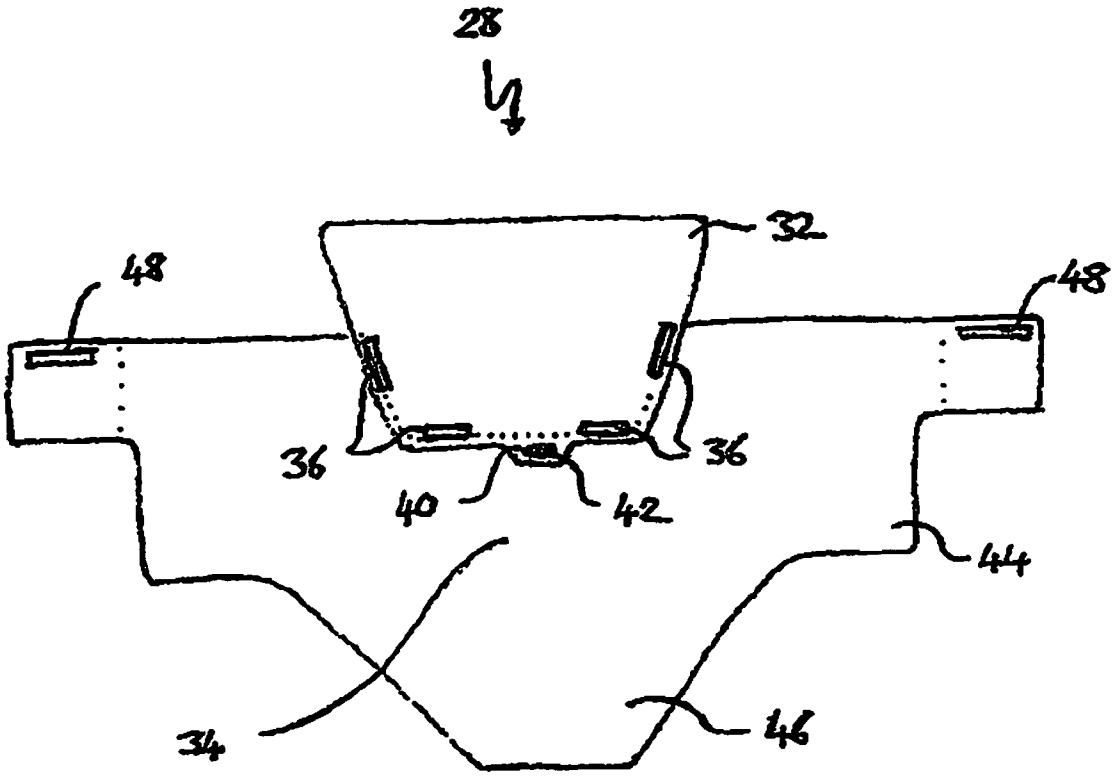
FIG. 14 shows a back view (inside) of the visor and integral skirt according to another embodiment of the present invention.

FIGS. 13 and 14 show a further embodiment of the invention that comprises a pocket 52 in the outside face of the skirt portion 34, positioned at the end, or generally towards the end of each arm 44. The pocket openings approximately face the central line of the protective visor unit 28 that extends through the visor portion 32. The pockets 52 may accommodate at least one of the user's hands and are used for sterile donning of the protective visor unit 28 that will now described with references to FIGS. 15 to 19.

FIGS. 15 to 19 show the procedure for donning the protective visor unit 28 of an embodiment of the invention.

Figure 15:
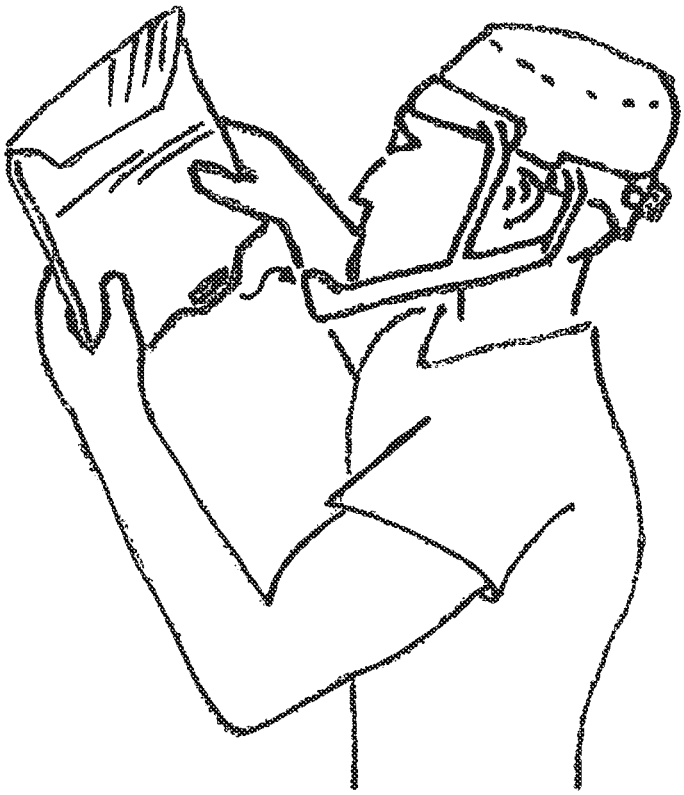
FIGS. 15 to 19 show the procedure for donning the integrated visor and skirt of an embodiment of the invention.

As shown in FIG. 15, the user places the headpiece 10 on their head and adjusts the headband 12, and in certain embodiments, the mandible guard 14, to ensure a secure and comfortable fit. In the situation where the mask is to be used in a sterile environment, such as an operating theatre, this stage may be done prior to the surgeon "scrubbing-in" (decontaminating the hands and forearms prior to surgery).

The protective visor unit 28, is to be provided suitably folded such that the two arms 44 of the skirt portion 34 are on the outside of the folded pack, and may therefore be unfolded first. It is envisaged that the folded protective visor unit will be provided in a sterile pack for when the mask is to be used in a sterile environment.

In the embodiment shown, the visor portion 32 of the protective visor unit 28 comprises the extension 40 with the opening 42 formed therein for receiving the fixing point 22. In the embodiment shown, the fixing point 22 is in the form of a hook, located on the front apex of the mandible guard 14. In a second step, the user securely locates the opening 42 on the fixing point 22. The protective visor unit 28 is oriented on the headpiece 10 such that the exposed face of the visor portion 32 of the protective visor unit 28 is towards the face of the user with the folded skirt portion 34 on the opposite face away from the user.

Figure 16:
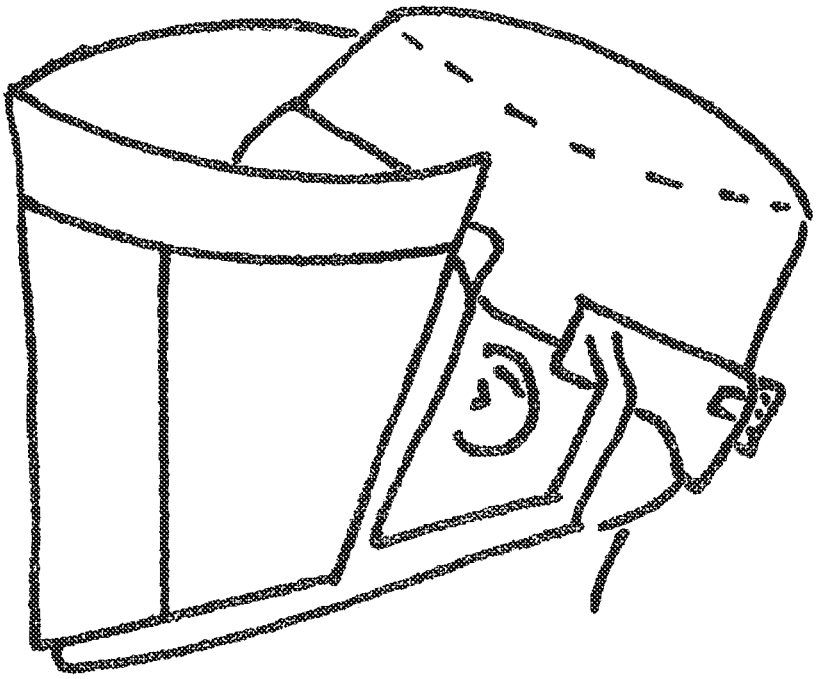
Figure 17:
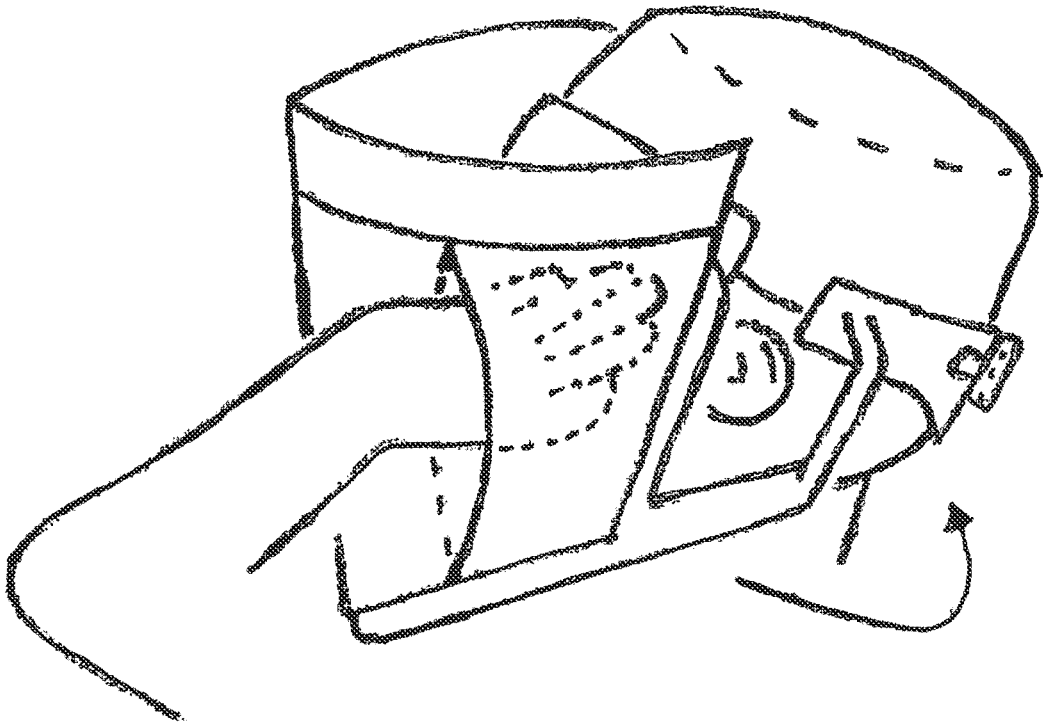

As shown in FIG. 16, once the protective visor unit 28 is suitably located on the fixing point 22, the user pushes back on each side of the protective visor unit 28 to causing it to bend allowing the attachment points on the mandible guard 14 and struts 16, and if required, the cooperative attachment points on the visor portion of the protective visor unit 28 to engage thereby securing the protective visor unit 28 to the headpiece 10.

The arms 44 of the skirt portion of the protective visor unit 28 may now be unfurled by the user from their folded position on the front of the protective visor unit 28. This step is shown best in FIG. 17.

In an embodiment of the invention where there are no pockets 52 on the arms 44 of the skirt portion 34, the arms 44 of the skirt portion may simply be peeled from the front of the protective visor unit 28 before fixing them around the back of the head. Fixing of the arms in position at the back of the head may be done by the user, or in the case where the protective visor unit is sterile, the fixing may be done by an assistant to preserve sterility. In the embodiment of the invention where pockets 52 are located on the external face of the skirt portion 34, then the user may advantageously position their hands in the pockets and proceed to extend the arms to the back of the head where they may be fixed. As described above, fixing means on the arms 44 may attached to each other or to the area 19 on the elongation of the headband. Alternatively, the arms may simply be tied.

Figure 18:
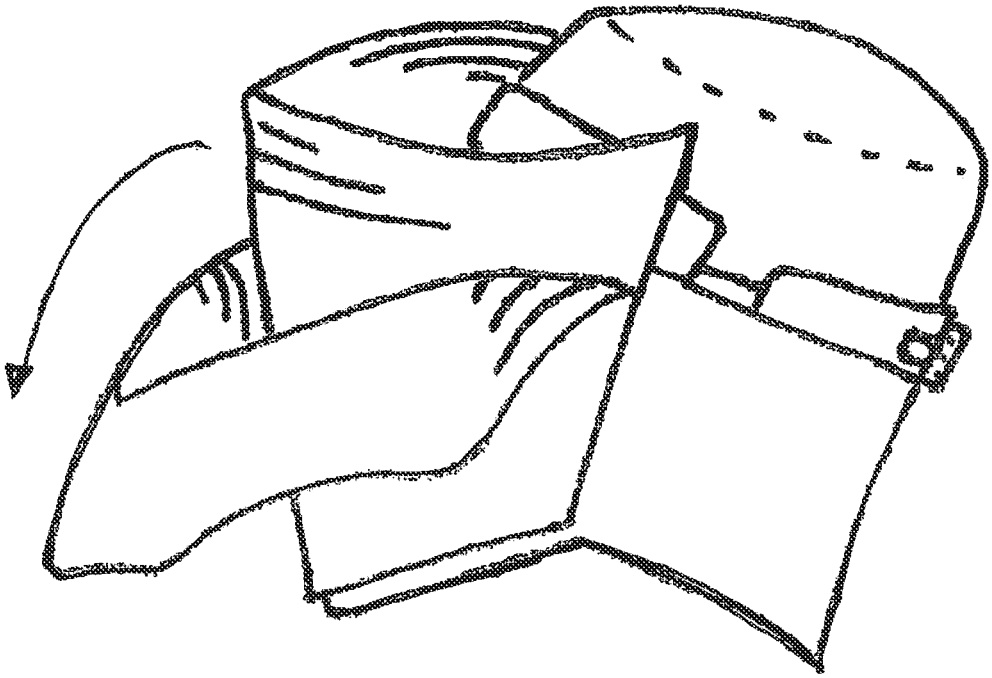
Figure 19:
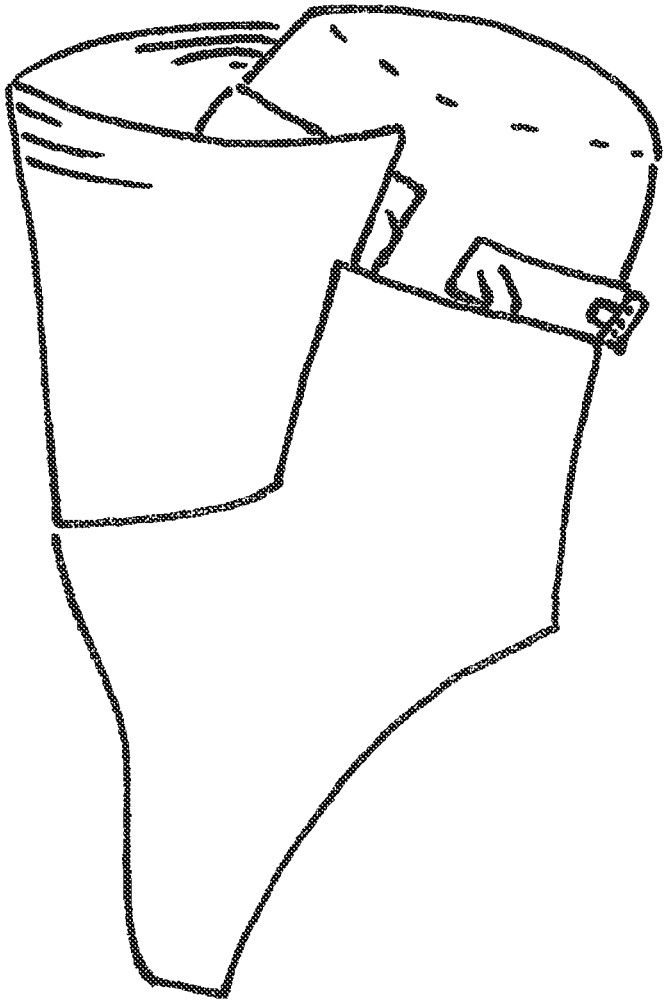

As shown in FIG. 18, once the arms have been unfolded from the front of the protective visor unit 28, the folded torso portion 46 of the skirt portion 34 is then exposed on the front of the visor portion 32. The torso portion 46 may then be peeled away and folded down to expose the transparent visor portion 32 below. The mask of an embodiment of the invention is now ready to use as shown in FIG. 19.

It is important to note that in the procedure above, the user only needs touch the protective visor unit 28. There is no need for the user to touch the headpiece after placing on the head. While not essential, it is contemplated that the protective visor unit 28 may be provided suitably sterilised, for example by gamma irradiation. In this embodiment of the invention, the procedure for donning the protective visor unit 28 to the headpiece may be achieved while maintaining a sterile field.

The protective mask as currently described is not limited to use in surgery or operating theatres. It will be appreciated by the skilled person that the protective mask can be adapted for use in any environment from which a user requires protection from minor debris and foreign contaminants. Hence, it is appropriate for the mask of the invention to be adapted for use in for example, dentistry, non-surgical doctors, nurses, chemical workers, those working with biological material, butchers, and tattoo artists. In non-sterile arrangements the visor and skirt, or the protective visor unit need not be sterilised, or be provided separate from the headpiece 10. For environments where the more significant debris is likely to be encountered, the visor 24, or visor portion 32 and skirt 26, or skirt portion 34 may be adapted, i.e. strengthened, to provide enhanced physical protection to the user.

It should be understood that the different embodiments of the invention described herein can be combined where appropriate and that features of the embodiments of the invention can be used interchangeably with other embodiments where appropriate.

Although particular embodiments of the invention have been disclosed herein in detail, this has been done by way of example and for the purposes of illustration only. The aforementioned embodiments are not intended to be limiting with respect to the scope of the appended claims, which follow. It is contemplated by the inventors that various substitutions, alterations, and modifications may be made to the invention without departing from the scope of the invention as defined by the claims.

What is claimed is:

1. A protective apparatus for coverage of the face, neck and upper torso, comprising:

a. a headpiece comprising a headband, a mandible guard and one or more support members, wherein the mandible guard is attached to the headband via the one or more support members, the headpiece further comprising at least one attachment point, wherein the at least one attachment point is located at a position on the headpiece selected from the group consisting of: the mandible guard, the one or more support members, and the combination thereof; and b. a protective visor unit comprising
a visor, and
a skirt;

wherein the visor is attached to the skirt to form a single unitary piece, wherein the protective visor unit is attached to the headpiece via the at least one attachment point, wherein the skirt has an upper edge that is attached only to at least one of a bottom and sides of the visor, and wherein the skirt is configured to extend downwardly around at least a part of the circumference of a user's head.

2. The apparatus of claim 1, wherein the mandible guard is configured to be spaced from the face.

3. The apparatus of claim 1, wherein the attachment of the protective visor unit to the headpiece via the at least one attachment point is temporary, and the attachment is selected from the group consisting of: hook and loop tape, magnets, press-stud, adhesive, and a combination thereof.

4. The apparatus of claim 1, wherein the attachment of the protective visor unit to the headpiece via the at least one attachment point is fixed and the attachment is selected from the group consisting of: pins, rivets, screws, staples, welding, adhesive, and a combination thereof.

5. The apparatus of claim 1, wherein the visor has at least a transparent portion.

6. The apparatus of claim 5, wherein the transparent portion occupies at least 60% of an area within a field of view of the user.

7. The apparatus of claim 5, wherein the transparent portion occupies 100% of an area within a field of view of the user.

8. The apparatus of claim 1, wherein the visor is formed of a flexible material.

9. The apparatus of claim 1, wherein the visor extends upwardly from the mandible guard to at least the height of the headband substantially covering the face of a user.

10. The apparatus of claim 1, wherein on a plane P that bisects the headband down a central line from front to back, the visor intersects a straight line between the mandible guard and the headband with an internal angle of more than 0° and less than 60°.

11. The apparatus of claim 1, wherein there is an opening between a front most point of the headband and the visor.

12. The apparatus claim 1, wherein the headband is circumferentially adjustable wherein the adjustment of the circumference of the headband is mediated via a mechanism selected from the group consisting of: a mechanical adjuster, a snap fitting, a buckle, a hook and loop fastener, and elastic.

13. The apparatus of claim 1, wherein in use the skirt is configured to extend downwardly from the headpiece around at least a part of the circumference of a user's head.

14. The apparatus of claim 1, wherein the skirt comprises two arms and a downwardly extending torso portion, wherein the skirt further comprises a fixing towards the end of at least one arm.

15. The apparatus of claim 14, wherein the fixing is fixed at the rear of the head.

16. The apparatus of claim 1, wherein the skirt is made of a material selected from the group consisting of: a fabric and a flexible polymeric material.

17. The apparatus of claim 16, wherein the material is non-woven fibre, cotton, gauze, silk, polyester, moisture-wicking fabric, or elastic fiber material.

18. The apparatus of claim 1, wherein the headpiece and protective visor unit are formed as a singular unit.

19. A kit comprising the apparatus of claim 1, wherein the kit is provided as a sterile pack.

20. The apparatus of claim 1, wherein the skirt is configured to extend only downwardly around at least a part of the circumference of a user's head.

* * * * *